United States Patent [19]

Strauss

[11] 4,272,911

[45] Jun. 16, 1981

[54] SPINNING TOY

[75] Inventor: Manfred Strauss, Randolph, N.J.

[73] Assignee: Shelcore, Inc., New York, N.Y.

[21] Appl. No.: 945,401

[22] Filed: Sep. 25, 1978

[51] Int. Cl.[3] ..... A63H 1/32

[52] U.S. Cl. ..... 46/47; 46/107

[58] Field of Search ..... 46/100, 114, 1 R, 138, 46/140, 99, 107, 32, 207, 47, 97, 98, 106; 273/58 F

[56] References Cited

U.S. PATENT DOCUMENTS

| | | | |
|---|---|---|---|
| 955,435 | 4/1910 | Reed | 46/100 UX |
| 1,258,464 | 3/1918 | Riley | 273/58 F |
| 2,351,762 | 6/1944 | Hoover | 46/1 R |
| 2,402,861 | 6/1946 | Winnick | 46/32 |
| 2,519,248 | 8/1950 | Hulbert | 46/100 |
| 2,575,743 | 11/1951 | Biggs | 46/207 |
| 3,058,261 | 10/1962 | Lakin | 46/99 |

FOREIGN PATENT DOCUMENTS

| | | | |
|---|---|---|---|
| 666034 | 9/1938 | Fed. Rep. of Germany | 46/100 |
| 1029487 | 6/1953 | France | 46/207 |

OTHER PUBLICATIONS

"Rattle Ball", by Fisher-Price, *Playthings*, p. 477, 3/1959.

*Primary Examiner*—Gene Mancene
*Assistant Examiner*—Mickey Yu
*Attorney, Agent, or Firm*—Kirschstein, Kirschstein, Ottinger & Cobrin

[57] ABSTRACT

A toy having a transparent hollow outer shell is formed in the shape of a surface of revolution with an axis of symmetry and contains an object visible through said shell. The object is clear of the inner surface of the shell. A flexible elastic band having spaced points of connection to the shell and located on said axis of symmetry is fixed to and supports the object between said connection points. The object's center of gravity is below said band. Rolling of the shell about its axis twists the band as the center of gravity of the object remains below the band. When the band has stored up enough energy, it untwists and spins the object first in one direction and then reversely.

10 Claims, 3 Drawing Figures

SPINNING TOY

BACKGROUND OF THE INVENTION

1. Field of the Invention

A spinning toy which whirls an object within a transparent shell.

2. Description of the Prior Art

Toys in which an object is located in a ball are well known, being shown, for example, in U.S. Pat. No. 955,435; 1,395,670; 2,351,762 and 3,058,261. In U.S. Pat. No. 3,058,261 a spindle within a transparent ball carries an object. The spindle is free and is slightly shorter than the diameter of the ball.

SUMMARY OF THE INVENTION

1. Purposes of the Invention

An object of the present invention is to provide a novel spinning toy.

Another object is to provide a spinning toy having an object centrally disposed within a hollow transparent shell, which toy can be used in connection with water play for small children.

Another object is to provide a spinning toy which allows children to observe the spinning motion of a contained object when it is subjected to external forces.

Another object is to provide a spinning toy which is durable and resistant to abuse.

Another object is to provide a spinning toy which allows children to observe the inside and touch the outside of a shell.

Another object is to provide a spinning toy which is amusing and interesting and appealing to all age levels, being not only highly entertaining to operate and watch, but also serving to demonstrate a number of physical laws and principles.

Another object is to provide a spinning toy with which children can learn to distinguish the difference between stable and labile equilibrium.

Another object is to provide a spinning toy which illustrates the principle of rotational inertia.

Another object is to provide a spinning toy which teaches muscular coordination and provides manual exercise for small children.

Another object is to provide a spinning toy which is inexpensive and is easy to manufacture.

Another object is to provide a spinning toy which can be operated by small children having little manual dexterity.

These and other objects and advantages of the present invention will become evident from the description which follows.

2. Brief Description of the Invention

Briefly, this invention relates to a spinning toy comprised of an outer shell with a hollow interior, the outer shell having a curved exterior surface with at least one axis of symmetry about which the shell can roll on a flat surface. The shell is comprised of a transparent, self-form-maintaining material. A flexible elastic support band within the shell has two spaced points fixedly secured to spaced sections of the shell lying on the axis of symmetry thereof. An object, visible from the exterior of the shell, is fixed to the support band between said connection points. The support band holds the object within the hollow interior of the shell and out of contact with the inner surface thereof. The center of gravity of the object is below the band. This preferably is accomplished by placing a ballast within the object, e.g. sand or weights, near the bottom thereof, thus tending to retain the object in an upright position.

When the shell is rolled about its axis of symmetry along a horizontal surface, the support holding the object within the shell, being fixed at its opposed ends to the shell, rotates the shell while the rotational inertia of the object keeps the object upright within the shell. This rotation of the support band relative to the object causes the support band to twist along its length relative to the object and thereby to store torsional energy until the rotational inertia of the object is overcome. When this occurs, the support band unwinds in a sense of rotation opposite to the wind-up sense. As it unwinds, the support band exerts a rotational force on the object, spinning the object about the axis of symmetry of the shell. This unwinding of the support band may occur while the shell still is rotating along its axis of symmetry. When the shell is rolled on a surface about its axis of symmetry, the energy required to wind up the support band tends to act as a brake on rotation of the shell.

The rotational momentum of the object, once it begins to whirl about the axis of symmetry of the shell, tends to keep it whirling. Since the object is fixedly secured to the support band, the support band rotates in kinematic unison with the object as the latter whirls. Moreover, since the opposite ends of the support band are fixedly secured to axially opposed sections of the shell, which are either rotating in the same sense as or in an opposite sense of rotation to that of the whirling object or are rotationally stationary with respect to the whirling object, the relative rotation of the support band with respect to its opposite ends first cause the band to untwist and then to twist into an opposite helical configuration and become wound up again. This action of rotation and counter-rotation of the object is repeated a few times until frictional forces reduce the energy stored in the band to a point that it is insufficient to overcome the rotational inertia of the object, whereupon the object stops spinning.

This invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
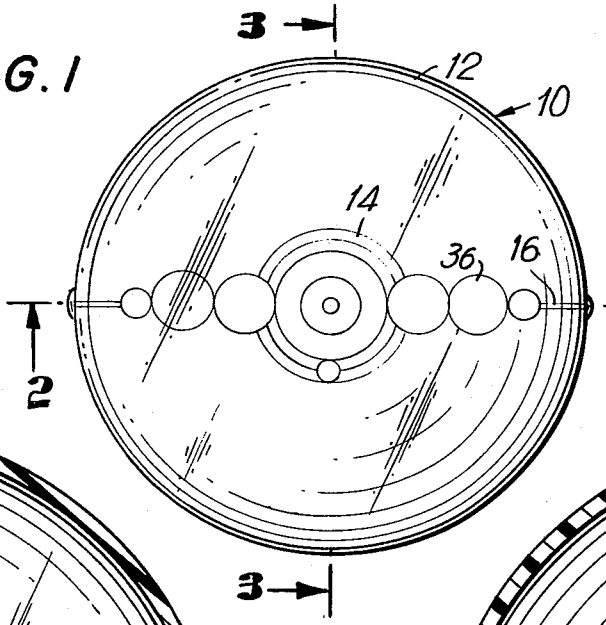
FIG. 1 is a top plan view of the spinning toy of the present invention.
Figure 3:
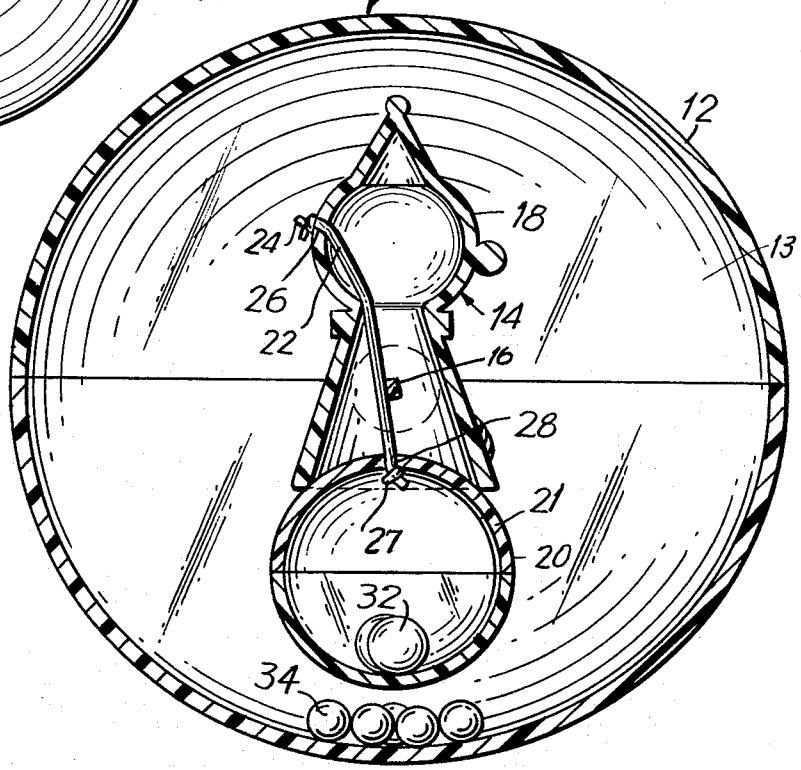
FIGS. 2 and 3 are enlarged sectional elevation views of the toy taken substantially along the lines 2—2 and 3—3, respectively, of FIG. 1.
Figure 2:
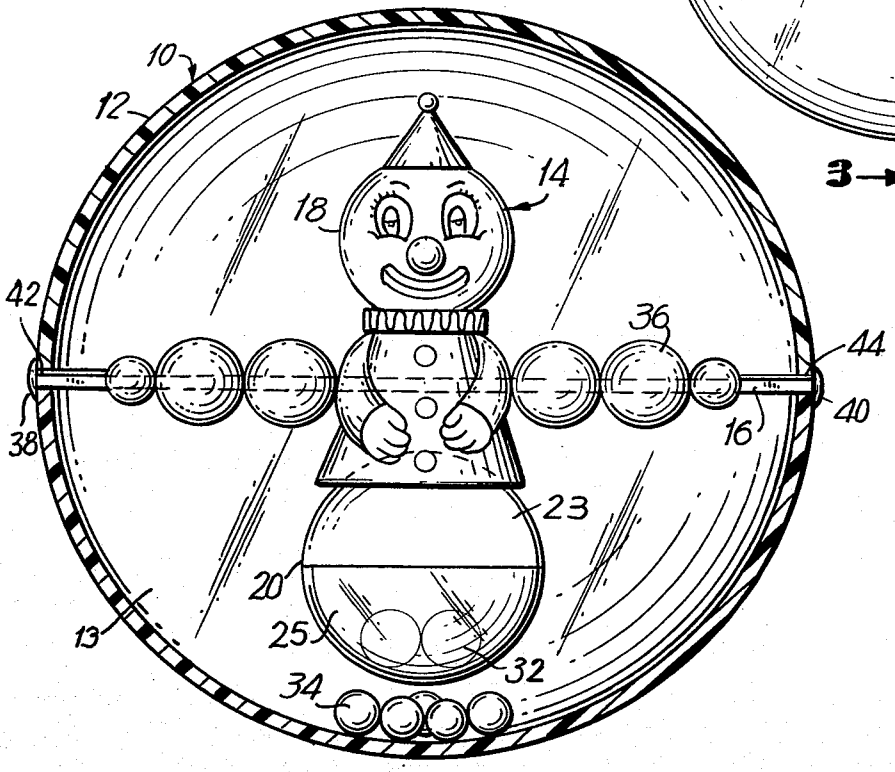

Referring now to FIGS. 1, 2 and 3, wherein like numerals indicate like parts, there is shown a preferred embodiment of a spinning toy 10 of this invention. The toy 10 has a transparent outer self-form-maintaining shell 12 with a hollow interior 13. The exterior surface of the shell is in the shape of a surface of revolution having at least one axis of symmetry. It could be a cylinder or cone or an ovoid or a dumbbell. The outer shell 12 is shown in the form of a hollow sphere. Situated within a central portion of the interior 13 and spaced from the inner surface of the outer shell 12 is an object, e.g. an elongated figurine 14. The shell 12 is optically transparent so that the figurine 14 is visible from the exterior of the shell 10. Typically, the shell is made of a transparent plastic, e.g. polyethylene, of a gauge sufficiently thick for the shell to maintain its spherical shape.

As shown in FIGS. 2 and 3, the figurine 14 has the form of a clown. However, any suitable form of mock or abstract object may be employed, including animal figures such as a tiger, monkey, rabbit or dog; humanoid figures such as toy dolls or face caricatures of well-known personalties; flying objects such as butterflies, birds or airplanes; fruits such as bananas or pears; vegetables such as carrots; the forms being suitably decorated, e.g. decorated to resemble human features or decorated abstractly with bright colors to capture the attention of a small child.

The figurine 14 is suspended within a central portion of the shell by a flexible elastic support means 16 in the form of a rubber band, the ends of which are secured to diametrically opposite points of the shell that lie on an axis of symmetry of the shell. The figurine is non-rotatably secured to the band.

As shown particularly in FIGS. 2 and 3, the figurine 14 is comprised of an upper half 18 and a lower half 20. The upper half 18 is a molded plastic or rubber piece which has a hollow interior and has the form of the torso and head of a mock figure dressed as a clown. The band is threaded through opposed openings in the sides of the torso, the openings being smaller than the cross-sectional area of the band so that the band is constricted when it passes through said openings, thus obtaining a non-rotatable connection between the band and the figurine. The lower half 20 of the figurine is comprised of an upper hemisphere 23 and a lower hemisphere 25. As shown in FIGS. 2 and 3, the upper hemisphere 23 is non-transparent and the lower hemisphere transparent. Either or both of the hemispheres 23 and 25 of the lower half 20 may be made of a transparent or opaque material. The lower half 20 has an exterior wall 21 with a globular form and a hollow interior. The upper hemisphere 23 of the lower half 20 fits snugly within an open mouth at the lower end of the upper half 18 of the figurine 14. The lower half 20 is held within this open mouth and to the upper half 18 by a flexible elastic band 22 with two ends 24, 27. One end 24 is situated exteriorly of the upper half 18 of the figurine 14 and extends through the upper half 18 passing through a slit 26 in the upper half 18 and toward the lower half 20 of the figurine 14. The other end 27 is situated interiorly of the wall 21 of the lower half 20 of the figurine 14. At a lower portion of the upper half 18 the band 22 passes through a slit 28 in the wall 21 in an upper portion of the wall 21 of the lower half 20. Terminal portions of the ends 24, 27 are knotted so that they cannot pass through the slits 26, 28, respectively. The band 22 is under tension so as to hold the two halves of the figurine together.

The figurine 14 has a ballast material 32 such as sand or a weight in the bottom half 20 so that the center of gravity is below the support band 16, thus tending to retain the figurine 14 in a substantially upright position. As shown in FIGS. 2 and 3, the ballast material 32 is in the form of one or more balls. This has the added advantage of producing a sound when the figurine 14 is shaken or rotated. The ballast material 32, for example, can be comprised of one or more spherical bells which would enhance the quality of sound produced when the figurine 14 is shaken or rotated.

Moreover, various objects 34 are freely movably contained within the outer shell 12. The objects 34, e.g. in the form of balls, contained in the outer shell 12 further enhance the sounds generated when the shell 12 is shaken or rotated. These objects 34 may also consist of one or more spherical bells.

To further enhance the enjoyment of the toy 10, the ballast material 32 and the objects 34 may be decorated with different colors or designs on exterior surfaces thereof. The ballast material 32 is visible from the exterior of the lower half through the transparent hemisphere 25 and the transparent shell 12.

Strung along the elastic support band 16 are beads 36 on either side of the figurine 14. Exterior surfaces of the beads 36 also may be decorated with suitable colors to add vibrance to the visual presentation of the toy 10. Each of the beads 36 has an open central bore. The band 22 is passed through each of the open bores to mount the beads on the elastic band 22. The opposite ends 38, 40 of the band 22 pass through slots 42, 44, respectively, situated at diametrically opposite ends of the outer shell 12. As pointed out above, the slots are smaller than the cross-sectional area of the band whereby the band is so tightly held in the slots that the ends of the band are fixed to the shell 12. The slots are located on an axis of symmetry of the shell. The terminal portions of the ends 38, 40 of the band 16 are situated exteriorly of the shell 12 and have a cross-sectional area which is greater than the cross-sectional area of the respective slots 42, 44 so that the terminal portions of the ends 38, 40 cannot pass inwardly through their respective slots 42, 44. Preferably, this may be accomplished by knotting the ends 38, 40 on the exterior of the shell 12.

The shell is made in two hemispherical parts which are fastened together such as by heat sealing or cementing.

Suitable transparent materials for the outer shell 12 comprise clear thermoplastics of low crystallinity such as polyethylene, polystyrene, polymethyl methacrylate, polyvinyl chloride, polyacrylonitrile and the like.

Suitable materials for the support band 16 comprise elastomers such as neoprene or rubber.

The figurine 14 has been shown as comprising an upper half 18 and lower half 20. If desired, the figurine 14 may be of one-piece construction with the ballast material 32 integrally formed therewith or inserted through an opening at the base of the figurine 14.

As can be seen, the toy 10 can be rolled, shaken, spun or floated on water for the amusement of small children. Moreover, the principle of inertia is illustrated by the whirling figurine 14 suspended within the shell 12. The smooth, outer non-deformable surface of the shell 12 permits handling by small children and the rolling, spinning type of play mentioned previously herein. Moreover, the hollow interior 13 of the shell 12 provides a natural buoyancy for the toy 10 so that it is readily adaptable for water play. In adaptation for water play, any openings in the shell 12 should be sealed so that the shell 12 is substantially impervious to water.

It thus will be seen that there is provided spinning toy which achieves the various objects of the invention and which is well adapted to meet the conditions of practical use.

As various possible embodiments might be made of the above invention, and as various changes might be made in the embodiment set forth above, it is to be understood that all matter herein described or shown in the accompanying drawings is to be interpreted as illustrative and not in a limiting sense. Thus, it will be understood by those skilled in the art that, although preferred and alternative embodiments have been shown and described in accordance with the Patent Statutes, the invention is not limited thereto or thereby.

Having thus described the invention, there is claimed as new and desired to be secured by Letters Patent:

1. A spinning toy comprising:

a transparent outer shell with a hollow interior, the exterior surface of said shell being in the shape of a surface of revolution with an axis of symmetry so that it may be rolled about said axis along a horizontal surface, an object disposed within said shell and spaced from the interior surface thereof, said object being visible through said shell from the exterior surface thereof, and a flexible elastomeric support band having end portions thereof fixedly secured to spaced points of the shell located on said axis of symmetry, said band supporting and being fixed to said object between said points, the center of gravity of said object being below said band, rotation of said shell about said axis of symmetry as it rolls in one direction on said surface causing said band to initially twist against the rotational inertia of said object without initially causing said object to spin, said object being sufficiently light in weight so that when after a finite time interval which sufficient energy has been stored up in said band by rolling of the shell on said surface in said one direction, the rotational inertia of the object is overcome by the stored energy in the band to suddenly spin the object without causing the toy to roll in a direction opposite to said one direction, whereby said band untwists completely to spin said object about the length of the band, the momentum of the spinning object causing said band to twist beyond the relaxed state and in an opposite or reverse sense of direction compared to the initial twisting of said band, said object rotating and counter-rotating about said band until friction substantially dissipates the stored energy.

2. A toy as defined in claim 1 wherein said object has ballast material at its bottom.

3. A toy as defined in claim 1 wherein said outer shell is comprised of a transparent thermoplastic.

4. A toy as defined in claim 3 wherein said thermoplastic is selected from the group consisting of polyethylene, polystyrene, polymethyl methacrylate, polyvinyl chloride and polyacrylonitrile.

5. A toy as defined in claim 1 wherein said object is comprised of two halves which are secured together.

6. A toy as defined in claim 1 further including freely movable spheres within said hollow interior of said shell.

7. A toy as defined in claim 1 further including at least one bead having an open bore passing axially therethrough, said band passing through said bore on said bead to mount said bead on said band.

8. A toy as defined in claim 2 wherein said ballast material is comprised of at least one freely movable sphere.

9. A toy as defined in claim 8 wherein said bottom of said object contains a window so that said freely movable sphere is visible from the exterior of said transparent shell.

10. A toy as defined in claim 1 wherein the object is elongated transversely to the band.

* * * * *